US007495615B2

(12) United States Patent
Yamanaka et al.

(10) Patent No.: US 7,495,615 B2
(45) Date of Patent: Feb. 24, 2009

(54) ANTENNA COUPLING MODULE

(75) Inventors: Kazunori Yamanaka, Kawasaki (JP); Isao Nakazawa, Kawasaki (JP); Masafumi Shigaki, Ohsato (JP)

(73) Assignee: Fujitsu Limited, Kawasaki (JP)

( * ) Notice: Subject to any disclaimer, the term of this patent is extended or adjusted under 35 U.S.C. 154(b) by 426 days.

(21) Appl. No.: 10/790,769

(22) Filed: Mar. 3, 2004

(65) Prior Publication Data

US 2004/0189533 A1 Sep. 30, 2004

(30) Foreign Application Priority Data

Mar. 25, 2003 (JP) ..... 2003-083141

(51) Int. Cl.
*H01Q 1/38* (2006.01)

(52) U.S. Cl. ..... 343/700 MS

(58) Field of Classification Search ..... 343/700 MS, 343/829, 830, 846, 852, 853, 826, 827
See application file for complete search history.

(56) References Cited

U.S. PATENT DOCUMENTS

| | | | | |
|---|---|---|---|---|
| 4,985,400 | A * | 1/1991 | Choudhury | 505/425 |
| 5,121,127 | A * | 6/1992 | Toriyama | 343/700 MS |
| 5,392,053 | A * | 2/1995 | Hirata et al. | 343/700 MS |
| 6,392,600 | B1 * | 5/2002 | Carson et al. | 343/700 MS |
| 6,753,817 | B2 * | 6/2004 | Aikawa et al. | 343/700 MS |
| 6,765,539 | B1 * | 7/2004 | Wang et al. | 343/795 |
| 6,798,384 | B2 * | 9/2004 | Aikawa et al. | 343/700 MS |
| 6,850,128 | B2 * | 2/2005 | Park | 333/26 |
| 2004/0100410 | A1 * | 5/2004 | Tsai et al. | 343/702 |

FOREIGN PATENT DOCUMENTS

| | | |
|---|---|---|
| JP | 05-102540 | 4/1993 |
| JP | 05-243843 | 9/1993 |
| JP | 10-032426 | 2/1998 |
| JP | 11-220409 | 8/1999 |
| JP | 11-274821 | 10/1999 |
| JP | 2000-201009 | 7/2000 |

OTHER PUBLICATIONS

Hein, Matthias; "High-Temperature-Superconductor Thin Films at Microwave Frequencies"; *Springer Tracts in Modern Physics*; (1999); pp. 300-389.
Zhi-Yuan Shen; "High-Temperature Superconducting Microwave Circuits"; *World Scientific*; (1994); pp. 101-145.
Portis, Alan M.; "Electrodynamics of High-Temperature Superconductors"; *Lecture Notes in Physics—vol. 48*; (1992); pp. 98-111.

* cited by examiner

*Primary Examiner*—Huedung Mancuso
(74) *Attorney, Agent, or Firm*—Kratz, Quintos & Hanson, LLP

(57) ABSTRACT

An antenna coupling module for electromagnetically coupling a planar antenna and a planar type oxide superconductive high frequency circuit not reducing the antenna effective area and sharply reducing the signal loss due to coupling, comprised of a planar antenna and a substrate forming a planar superconductive high frequency circuit arranged in a perpendicular direction with respect to the element surface of the planar antenna and having the planar antenna and the superconductive high frequency circuit electromagnetically coupled.

12 Claims, 2 Drawing Sheets

ANTENNA COUPLING MODULE

CROSS-REFERENCE TO RELATED APPLICATIONS

This application is based on and claims priority of Japanese Patent Application No. 2003-83141, filed on Mar. 25, 2003, the contents being incorporated by reference.

BACKGROUND OF THE INVENTION

1. Field of the Invention

The present invention relates to an antenna coupling module comprised of a planar antenna and a planar circuit type superconductive high frequency circuit and having the antenna and high frequency circuit electromagnetically coupled.

2. Description of the Related Art

As a planar circuit type antenna using a dielectric substrate, for example, one of a microstrip structure comprised of a pattern of dipole type, patch type, log-periodic, or other antenna elements formed on a substrate and having the opposite side of the substrate made a grounded surface may be mentioned, but various other patterns may also be considered. The input/output of high frequency electrical signals from the feeder point of the antenna elements is usually performed by the method of arranging a feeder line (transmission line) perpendicular to or on the same plane as the element plane. In the case of arrangement on the same plane, the method may be mentioned of forming the transmission line integrally with the antenna element pattern and arranging wirings with the transmission line to the input/output terminals on the substrate. Further, in the case of arrangement perpendicular to the element plane, the method maybe mentioned of arranging a feeder line passing through a through hole (via) so as to not directly contact the grounded surface at the opposite side of the substrate.

Further, when the impedance does not match with the feeder line or for balanced or unbalanced line transformation, there is the method of introducing a suitable matching circuit or balanced-to-unbalanced line transformer circuit, etc., between the feeder line and the antenna elements.

As a planar circuit type antenna, one using an oxide superconductor is being studied. With the microstrip structure, one forming a dipole type, patch type, log-periodic type, or other superconductive film pattern at one side of the dielectric substrate and forming a grounded surface by that superconductor or ordinary conductive metal at the opposite side of the substrate may be mentioned. Further, in a planar circuit type antenna using an oxide superconductor, the technique of forming a superconductor filter and a feeder point of antenna on the same dielectric substrate and transferring high frequency electrical signals between the filter and feeder point of the antenna is being studied. As a passive circuit using such an oxide superconductor, the technique of forming a film of a copper oxide high-temperature superconductor on a substrate and forming a high frequency filter or other circuit by a planar circuit (microstrip line type circuit, coplanar type circuit, etc.), may be mentioned (M. Hein, *High-Temperature Superconductor Thin Films at Microwave Frequencies,* Springer, 1999; Alan M. Portis, *Electrodynamics of High-Temperature Superconductors*, World Scientific, 1992; Zhi-Yuan She, *High-Temperature Superconducting Microwave Circuits*, Artech House, 1994; etc.) If selecting a suitable copper oxide high-temperature superconductor film material with excellent crystallinity, it is possible to obtain a lower surface resistance compared with the usual good electrical conductors of copper, silver, gold, aluminum, etc., at a quasi-microwave band, microwave band, etc. Therefore, it is known that use of this copper oxide high-temperature superconductive film material is advantageous for a low energy loss (hereinafter abbreviated as a "high Q-value", reciprocal of dielectric loss tangent) and formation of a high Q-value circuit. To form a superconductive planar type circuit, a pattern of a film of an oxide high-temperature superconductor is formed in accordance with need on one or both surfaces of the dielectric substrate such as magnesium oxide or lanthanum aluminate. The superconductive film epitaxially grown on the substrate perpendicularly with respect to the crystal lattice c-axis is advantageous for the formation of a high Q-value circuit. A YBCO superconductive film, etc., is used as the superconductive film.

Further, while there are problems in practical use, by making the operating temperature one near the temperature of liquid helium (LHe) (4.2K), a circuit using a superconductive film theoretically can be made a superior one using a usual good electrical conductor even for the milliwave band or more (0.3 THz or more).

An antenna coupling module comprising a combination of a planar antenna and a planar circuit type superconductive high frequency circuit is, for example, disclosed in Japanese Unexamined Patent Publication (Kokai) No. 5-95213 (in particular, the claims and FIGS. 1 and 5). This publication discloses an oxide superconductive antenna module comprised of a feeder system, matching circuit, and radiation element wherein the radiation element is formed by a meandering single line comprised of an oxide superconductive film and wherein the matching circuit is formed by a meandering type ¼ wavelength parallel coupling line made of an oxide superconductive film.

In the antenna module disclosed in this publication, planar antennas arrayed on the same plane and a planar circuit type superconductive high frequency circuit are formed on the same plane. Therefore, the plane where this circuit is arranged is thought to end up becoming considerably larger. Further, when forming an array of a large number of antenna elements and trying to couple a superconductive high frequency circuit to the antenna elements, the ratio of the effective area of the entire antenna in the entire circuit on the plane becomes smaller compared with the case where the superconductive high frequency circuit is not in the same plane. Therefore, to obtain the same sensitivity, there is the problem that the area of the plane becomes relatively large.

On the other hand, the no-load Q-value of a planar circuit type superconductive high frequency circuit depends on the circuit structure and material and in particular is an important factor in the crystallinity of the oxide superconductor. It is possible to obtain an oxide superconductive film (film mainly comprised of $YBa_2Cu_3O_{7-\delta}$ ($\delta$:0 to 0.2) epitaxial film with a strong c-axis crystal orientation perpendicular to the substrate surface) suitable for formation of a high Q-value circuit, but when formed into a 3D shaped part, it is not easy to obtain such an epitaxially grown film with a continuous oxide superconductive film.

According to the present invention, there is provided an antenna coupling module comprised of a planar antenna and a substrate forming a planar superconductive high frequency circuit arranged in a perpendicular direction with respect to the element surface of the planar antenna and having the planar antenna and the superconductive high frequency circuit electromagnetically coupled. In this way, the planar antenna and the substrate forming the superconductive high frequency circuit are arranged perpendicularly and the antenna and high frequency circuit are electromagnetically coupled via a space. Therefore, it is possible to arrange antenna elements at a high density and possible to produce a compact array antenna. By making this array antenna compact, it is also possible to make the system for cooling the conductors comprised of a superconductor compact as well, so it is to cut the cost of antenna production and the operating cost.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1A:
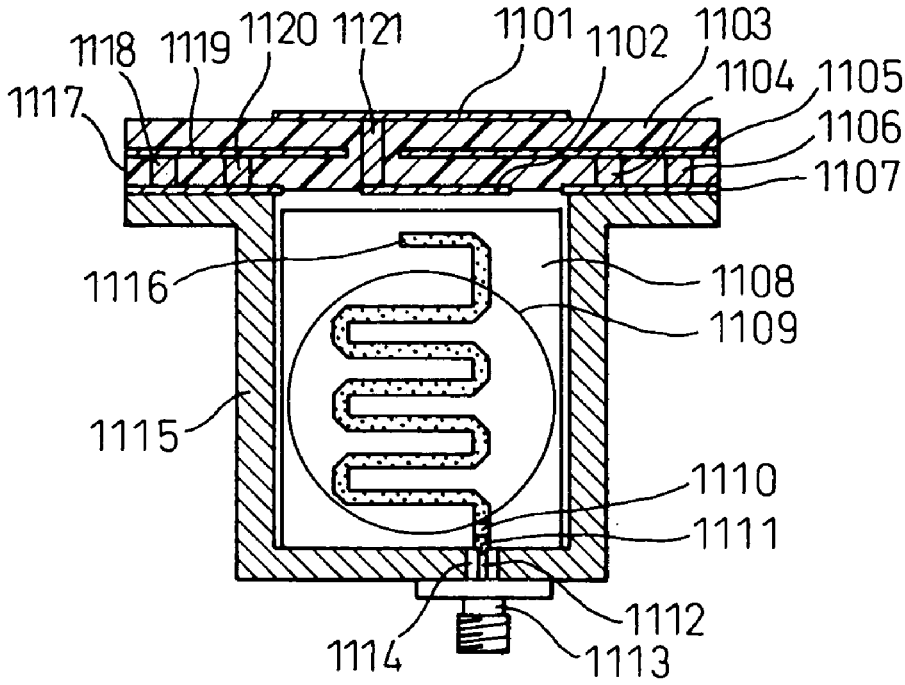
FIGS. 1A and 1B are schematic views of an antenna coupling module according to an embodiment of the present invention.

The present invention realizes an antenna coupling module electromagnetically coupling a planar antenna and a planar type oxide superconductive high frequency circuit which does not reduce the antenna effective area and which sharply reduces the signal loss due to connectors, etc., for coupling.

Exemplary embodiments of the present invention will be described in detail below while referring to the attached figures. The planar antenna used in the present invention is not particularly limited. It is possible to use all types of planar antennas which have been used in the past. For example, it is possible to use one comprised of a dielectric substrate on one side of which an antenna element comprised of a dipole type, patch type, log-periodic type, or other pattern is formed. Further, it is possible to use one of a microstrip structure with the opposite side of the substrate formed as a grounded surface by a conductor. Further, the antenna may also be an array antenna.

In the present invention, the high frequency circuit is separated from the planar antenna and arranged in a perpendicular direction with respect to the planar antenna. As a result of this, it is possible to reduce the area of the antenna plane by the amount that the high frequency circuit is not present on the plane comprising a planar antenna. Further, it is possible to reduce the area of the antenna plane by the amount not required for formation of a circuit for coupling the antenna and the high frequency circuit. Further, when arranging antenna elements in an array, since there is no high frequency circuit, it is possible to arrange the antenna array at a high density design wise.

The conductor forming the antenna element may be an ordinary conductive metal or an oxide superconductor. As an ordinary conductive metal, copper plated with gold may be mentioned.

The conductor of the antenna element is preferably an oxide high-temperature superconductor. Such a superconductor has a lower surface resistance compared with an ordinary conductive metal, gives a low energy loss (high Q-value), and improves the sensitivity in the case of reception and the radiation efficiency in the case of transmission. As the oxide high-temperature superconductor, $Bi_{n1}Sr_{n2}Ca_{n3}Cu_{n4}O_{n5}$ (where, $1.8 \leqq n1 \leqq 2.2$, $1.8 \leqq n2 \leqq 2.2$, $0.9 \leqq n3 \leqq 1.2$, $1.8 \leqq n4 \leqq 2.2$, and $7.8 \leqq n5 \leqq 8.4$), $Pb_{k1}Bi_{k2}Sr_{k3}Ca_{k4}Cu_{k5}O_{k6}$ (where, $1.8 \leqq k1+k2 \leqq 2.2$, $0 \leqq k1 \leqq 0.6$, $1.8 \leqq k23$ 2.2, $1.8 \leqq k4 \leqq 2.2$, $1.8 \leqq k5 \leqq 2.2$, and $9.5 \leqq k6 \leqq 10.8$), $Y_{m1}Ba_{m2}Cu_{m3}O_{m4}$ (where, $0.5 \leqq m1 \leqq 1.2$, $1.8 \leqq m2 \leqq 2.2$, $2.5 \leqq m3 \leqq 3.5$, and $6.6 \leqq m4 \leqq 7.0$), $Nd_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and 6.6 p4≦7.0), $Nd_{q1}Y_{q2}Ba_{q3}Cu_{q4}O_{q5}$ (where, $0 \leqq q1 \leqq 1.2$, $0 \leqq q2 \leqq 1.2$, $0.5 \leqq q1+q2 \leqq 1.2$, $1.8 \leqq q2 \leqq 2.2$, $2.5 \leqq q3 \leqq 3.5$, and $6.6 \leqq q4 \leqq 7.0$), $Sm_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Ho_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$) or combinations of the same can be mentioned.

The planar antenna substrate is not particularly limited. For example, it is possible to use a dielectric body comprised of magnesium oxide, mullite, forsterite, titanium oxide, lanthanum aluminate, sapphire, alumina, strontium titanate, magnesium titanate, calcium titanate, quartz glass, polytetrafluoroethylene (PTFE), polyethylene (PE), a polyimide (PI), polymethylmethacrylate (PMMA), a glass-epoxy composite, and a glass-polytetrafluoroethylene (PTFE) composite or a combination of two or more types of the same.

When the conductor forming the antenna element is an oxide high-temperature superconductive thin film, the dielectric substrate, in particular, a substrate for epitaxially growing a single crystal oxide high-temperature superconductor, is preferably for example a single crystal substrate made of magnesium oxide, lanthanum aluminate, strontium titanate, etc., but the invention is not limited to this.

In the present invention, it is possible to use a planar circuit type superconductive high frequency circuit as a high frequency circuit from the quasi-microwave band to several THz. In particular, at no higher than 100 GHz, by using a superconductive high frequency circuit at an operating temperature of tens of K or so, it is possible to secure a lower energy loss (higher Q-value) compared with a room temperature operating type high frequency circuit using copper, silver, gold, aluminum, or another good electrical conductor of the same shape.

As the planar circuit type superconductive high frequency circuit, it is possible to use a circuit obtained by forming a superconductive film on a dielectric substrate. As the dielectric substrate, in general a single crystal substrate of magnesium oxide, lanthanum aluminate, strontium titanate, etc., is used.

As the superconductive film, it is possible to use a film of an oxide high-temperature superconductor selected from $Bi_{n1}Sr_{n2}Ca_{n3}Cu_{n4}O_{n5}$ (where, $1.8 \leqq n1 \leqq 2.2$, $1.8 \leqq n2 \leqq 2.2$, $0.9 \leqq n3 \leqq 1.2$, $1.8 \leqq n4 \leqq 2.2$, and $7.8 \leqq n5 \leqq 8.4$), $Pb_{k1}Bi_{k2}Sr_{k3}Ca_{k4}Cu_{k5}O_{k6}$ (where, $1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, and $9.5 \leqq k6 \leqq 10.8$), $Y_{m1}Ba_{m2}Cu_{m3}O_{m4}$ (where, $0.5 \leqq m1 \leqq 1.2$, $1.8 \leqq m2 \leqq 2.2$, $2.5 \leqq m3 \leqq 3.5$, and $6.6 \leqq m4 \leqq 7.0$), $Nd_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Nd_{q1}Y_{q2}Ba_{q3}Cu_{q4}O_{q5}$ (where, $0 \leqq q1 \leqq 1.2$, $0 \leqq q2 \leqq 1.2$, $0.5 \leqq q1+q2 \leqq 1.2$, $1.8 \leqq q2 \leqq 2.2$, $2.5 \leqq q3 \leqq 3.5$, and $6.6 \leqq q4 \leqq 7.0$), $Sm_{p1}\ {}_{Bap2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Ho_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$) and combinations of the same. Such an oxide high-temperature superconductor is used grown epitaxially with a crystal lattice c-axis perpendicular to the dielectric substrate.

The planar circuit type superconductive high frequency circuit may be made a microstrip structure forming a high frequency circuit on the surface of a dielectric substrate and grounding the reverse or a co-planar structure having a grounded surface on the same surface as the high frequency circuit. Further, the high frequency circuit may be formed on both of the front and reverse surfaces of the dielectric substrate and may be formed as a multilayer structure.

As a superconductive high frequency circuit, a phase circuit, filter circuit, through line, delay circuit, coupler, distribution circuit, or composite circuit or combination of the same may be mentioned.

In the antenna coupling module of the present invention, the planar superconductive high frequency circuit is separated from the planar antenna element and the substrate forming the planar superconductive high frequency circuit is arranged in a perpendicular direction with respect to the element plane of the planar antenna.

By separating the planar type superconductive high frequency circuit from the planar type antenna element, it is possible to make the high frequency circuit a superconductive circuit and configure the antenna element by other than the superconductive circuit. For example, it is possible to make the antenna element a nonsuperconductive element and make just the high frequency circuit a superconductive element. Note that when making just the high frequency circuit a superconductive element, the effect is obtained that the system for cooling the superconductive element can also be made compact. Further, in the design of the planar antenna itself, by the elimination of the restrictions on forming the high frequency circuit in the same plane, there is the effect that formation in a high density is possible.

Further, by arranging the substrate forming the planar type superconductive high frequency circuit in a direction perpendicular to the element plane of the planar antenna, it is possible to eliminate the high frequency circuit from the antenna element plane and reduce the size of the antenna coupling module. Note that the "direction perpendicular to the element plane of the planar antenna" does not mean that the substrate forming the planar type superconductive high frequency circuit and the element plane of the planar antenna are completely perpendicular. While not necessary, they may also be inclined somewhat from the perpendicular direction. Cooling of the superconductive circuit requires much energy. Since it is possible to arrange the substrate forming the planar type superconductive high frequency circuit in a perpendicular direction with respect to the element plane of the planar antenna, the antenna coupling module as a whole becomes compact. As a result of this, the system for cooling the superconductive circuit can also be made more compact. As a result, there is the effect that it is possible to improve the energy efficiency of the antenna coupling module as a whole.

Further, the antenna coupling module of the present invention electromagnetically couples the element of the planar antenna and the superconductive high frequency circuit. For coupling the element of the planar antenna and the superconductive high frequency circuit, there is also the method of coupling by connection by the transmission line of a conductive line, but by using an electromagnetic coupling system through space (or a dielectric body), it becomes possible to more completely utilize the advantage of the configuration of separating the planar superconductive high frequency circuit from the element of the planar antenna. That is, by forming the planar type superconductive high frequency circuit and planar antenna independently, it is possible to produce them separately. Therefore, the degree of freedom of production of a superconductive high frequency circuit is increased, production becomes easier, and improvement of performance and greater compactness become possible. To realize a high Q-value by a superconductive high frequency circuit, it is desirable to form it on a single crystal substrate by epitaxial growth. In the case of electromagnetic coupling, however, there is no need for conductor coupling for coupling the superconductive high frequency circuit and antenna element, so it is possible to independently easily produce only such a high Q-value superconductive high frequency circuit.

The method of electromagnetically coupling a planar antenna and superconductive high frequency circuit used may be any known method. There are also methods of using a near electric field, near magnetic field, or mixed electromagnetic field.

In general, as the coupling circuit at the input/output of the feeder point of the planar antenna and antenna of the superconductive high frequency circuit, it is sufficient to provide a feeder lines, respectively. As the feeder line, a ¼ wavelength type is desirable from the viewpoint of its being relatively small dimension-wise in terms of a distributed constant circuit and of the ease of excitation of the electromagnetic field. A feeder line of the ½ wavelength type or any length less than ½ wavelength even though easily falling in coupling efficiency is also possible. It is also possible to adjust the impedance matching at a ¼ wavelength type or ½ wavelength type coupling.

The perpendicular distance between the planar antenna and the substrate forming the superconductive high frequency circuit electromagnetically coupled with it is preferably short so as to reduce the loss. The distance is preferably ¼ the effective wavelength or shorter. Further, to strengthen the coupling of the signal and fix the relative positional relationship between the planar antenna and superconductive high frequency circuit, it is preferable to arrange a dielectric body. As such a dielectric body, magnesium oxide, mullite, forsterite, titanium oxide, lanthanum aluminate, sapphire, alumina, strontium titanate, magnesium titanate, calcium titanate, quartz glass, polytetrafluoroethylene (PTFE), polyethylene (PE), a polyimide (PI), polymethylmethacrylate (PMMA), a glass-epoxy composite, and a glass-polytetrafluoroethylene (PTFE) composite or a combination of two or more types of the same may be used.

In this way, conventional technology can be used for the configuration and method of production of an antenna coupling module other than that arranging the antenna element and superconductive circuit in the perpendicular direction and electromagnetically coupling them. That is, the configuration and method of production of the antenna element are known. Further, the configuration and methods of production and cooling of the superconductive circuit, the method of taking out the output from the superconductive circuit, etc. are also known.

As one preferred embodiment of the present invention, it is possible to use an individual antenna coupling module arranging an antenna element and superconductive high frequency circuit in the perpendicular direction and electromagnetically coupling them and further to arrange the individual antenna coupling modules in an array to form an arrayed antenna coupling module. In the case of an array of these modules as well, as explained above, with the individual antenna coupling module of the present invention, only an antenna is required at the antenna element plane. There is no restriction on the high frequency circuit and the coupling means between the antenna and the high frequency circuit, so even when arranging such individual modules in an array, it is possible to arrange a plurality of antenna modules in a substantially ideal array.

According to the present invention, it is made possible to produce a high performance compact antenna. This is useful for the construction of a telecommunications base for transmitting and receiving electromagnetic waves of a wavelength of not more than the microwave band where future demand is particularly expected.

EXAMPLES

Next, a further explanation will be given using examples so as to illustrate the present invention.

Example 1

Figure 1B:
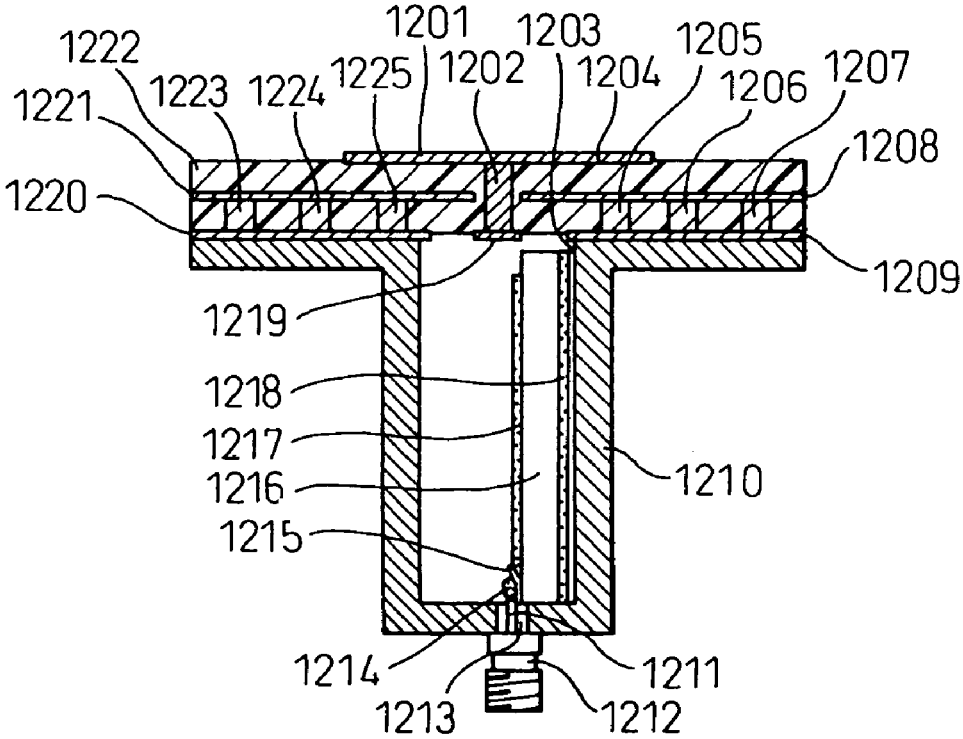

FIGS. 1A and 1B are schematic views of an antenna coupling module of an example of the present invention. In this example, the planar antenna is made a microstrip type of a patch of a quadrangular pattern, and a substrate forming a planar circuit type superconductive high frequency circuit is arranged in a perpendicular direction with respect to the element plane. As the coupling circuit, a ¼ wavelength type feeder line is used. FIG. 1A is a schematic view of the cross-section when cutting the antenna coupling module in a direction parallel to the substrate having the superconductive high frequency circuit. In FIG. 1A, reference numeral 1101 is a patch antenna element. A cross-section of the quadrangular conductor pattern is shown. An effective ½ wavelength of the transmitted/received wave is the rule of thumb for determining the pattern dimensions. An electromagnetic field simulator, etc., is used for the design. Reference numeral 1102 is an effective ¼ wavelength type feeder pattern, while reference numeral 1103 is a substrate material for forming the antenna, i.e., a dielectric substrate comprised of a polytetrafluoroethylene (PTFE)-glass composite. Reference numerals 1104, 1106, 1118, and 1120 are vias, while reference numerals 1105, 1107, 1117, and 1119 are grounding conductor layers. Reference numeral 1121 is a via connecting the feeder point of the antenna element 1101 and the feeder pattern 1102. As the conductor, copper plated with gold is used. In this case, for example, with transmission and reception near 10 GHz, the effective ½ wavelength of the quadrangular pattern 1101 is about 1 cm. In FIG. 1A, the antenna element 1101 may be a length of the effective ½ wavelength in a direction parallel to the paper surface and a length of less than the effective ½ wavelength in the perpendicular direction. Reference numeral 1108 is a magnesium oxide single crystal substrate forming a high frequency circuit comprised of an oxide superconductive film. The superconductive film-forming face of the substrate surface is (100), while the substrate thickness is 0.5 mm. Reference numerals 1116 and 1109 are circuit patterns of an oxide superconductive film with a strong c-axis orientation. A Y-Ba-Cu-O system or Gd-Ba-Cu-O system having an average film thickness of 0.4 mm is used. The circuit pattern 1116 is an effective ¼ wavelength type feeder. The circuit pattern 1116 electrically couples with the feeder pattern 1102 and is also used for impedance transformation. The circled part 1109 is a delay line. The reverse side of the substrate 1108 on the entire surface is formed with an oxide superconductive film similar to the film on the front surface of the substrate 1108. Reference numeral 1110 is a contact electrode for electrical connection with a 50 ohm characteristic impedance coaxial connector (SMA type) shown by 1113, 1112, and 1114 and is formed by vacuum deposition of silver or another metal. Reference numeral 1111 is a bonding material. Iridium solder or silver paste is used. When the thickness of the substrate 1108 is 0.5 mm, the widths of the lines 1116, 1109, and 1110 are made 0.5 mm for impedance matching at the time of operation with a co-axial connector. Reference numeral 1115 is a metal package comprised of Invar alloy, copper, or aluminum plated with silver to a thickness of 3 mm with an underlayer of nickel.

FIG. 1B is a schematic view of the inside cross-section seen from a direction rotated 90 degrees about the perpendicular axis of FIG. 1A. Reference numeral 1201 is a element part of a patch antenna and shows the cross-section of the quadrangular conductor pattern. Reference numeral 1219 is an effective ¼ wavelength type feeder pattern, reference numeral 1222 is a substrate material for forming an antenna, and reference numerals 1205, 1206, 1207, 1223, 1224, and 1225 are vias including the vias shown in FIG. 1A. While the illustration is omitted for simplification, a dense arrangement of vias is preferable for preventing useless operational instability. At 10 GHz, in the case of the material of this example, the intervals are made for example not more than 0.2 cm. Reference numerals 1208, 1209, 1220, and 1221 are grounding conductor layers, while reference numeral 1202 is a via for connecting the feeder point of the antenna element 1201 and the feeder pattern 1219. Reference numeral 1216 is a substrate for an oxide superconductor, reference numerals 1217 and 1218 are oxide superconductor films with strong c-axis orientations, reference numeral 1217 is a circuit pattern surface, and reference numeral 1218 is a grounded surface. Reference numeral 1215 is a contact electrode for electrical connection with the coaxial connector shown by 1212, 1211, and 1213. Reference numeral 1214 shows a binding material. Reference numeral 1210 is a metal package, while reference numeral 1203 is an indium sheet layer for electrically and mechanically connecting the superconductive high frequency circuit substrate to the metal package 1210. The metal package 1210 is thermally connected to the cooling end of a refrigeration machine and cools the circuits to 30 to 70K for circuit operation. Note that in FIGS. 1A and 1B, for simplification of the illustration, the screws, jigs, the cooling system, etc., such as a cryostat are omitted.

According to Example 1, the feeder line loss between the superconductive high frequency circuit and antenna can be ignored and the loss can be lowered. Therefore, compared with a combination of an ordinary conductive high frequency circuit and the same type of antenna, it is possible to use a high Q-value circuit. This is advantageous for raising the sensitivity in the case of reception. When the superconductive high frequency circuit 1109 is a filter circuit comprised of a plurality of resonators, it is possible to secure a lower path loss and frequency selectivity compared with a circuit of the same configuration using an ordinary conductive metal for the conductor patterns. For example, if arranging a plurality of patterns having pattern lines 1109 of the same line width and a length of an effective ½ wavelength in series at suitable intervals, connecting the feeder line 1116 in series with a space, and arranging a feeder line similar to the feeder line 1116 in series with a space at the coaxial connector side, a bandpass filter can be constructed.

Further, the feeder line 1116 and feeder pattern 1102 can have a dielectric body comprised of sintered alumina of a purity of 99.9% sandwiched between them. By securing it by a polyimide-based adhesive, it is possible to improve the signal coupling between the feeder line 1116 and feeder pattern 1102.

Example 2

Figure 2:
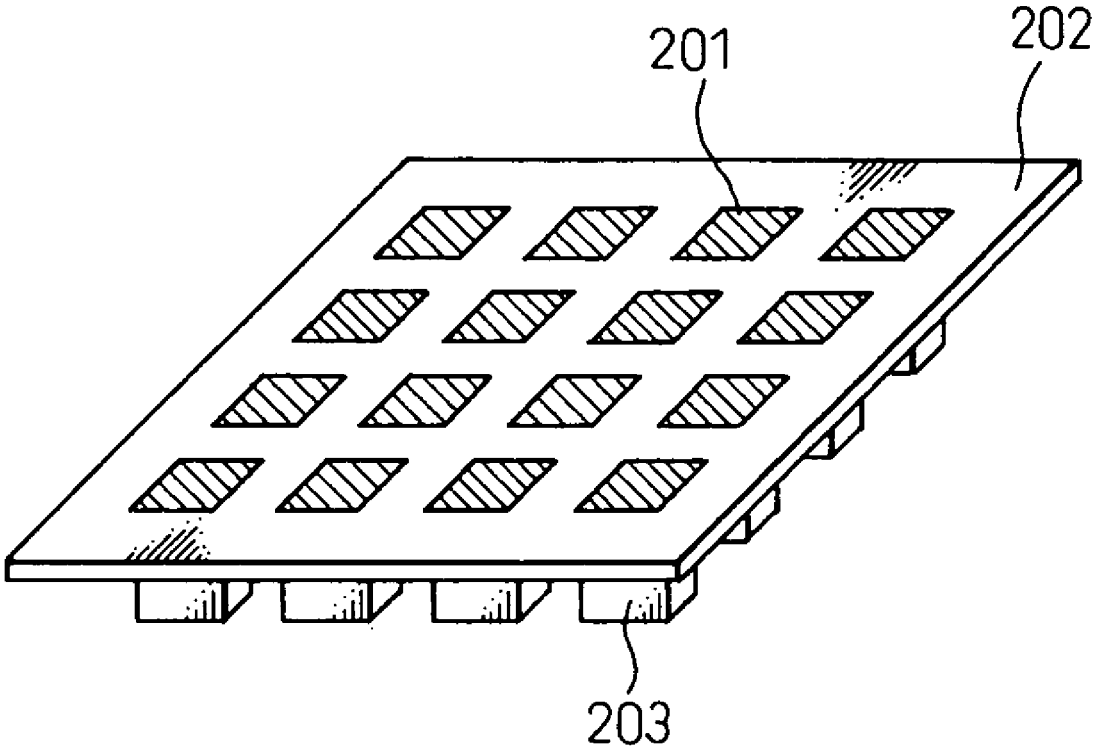
FIG. 2 is a perspective view of an array antenna using the embodiment of FIG. 1 as a component element.

FIG. 2 is a perspective view of an array antenna using Example 1 as a component. Reference numeral 201 is a conductor pattern of a patch antenna element of a quadrangular pattern. Reference numeral 202 is an antenna circuit substrate comprised of the same material as Example 1. The circuit of Example 1 is formed for each element pattern 201. However, a circuit corresponding to the total of 16 element patterns is formed integrally at the substrate 202. The grounded surface is shared. Reference numeral 203 is a package with a coaxial connector housing the superconductive high frequency circuit. Each is coupled with the pattern 201 directly above via the board 202 and is configured the same as in Example 1. In FIG. 2 as well, for simplification of the illustration, the screws, jigs, the cooling system etc., such as a cryostat etc. are omitted. According to Example 2, in addition to the effects of Example 1, since no high frequency circuit connected with the antenna element is arranged on the surface of the dielectric substrate forming the antenna elements, antenna elements can be arrayed at a high density.

Summarizing the effects of the invention, according to the present invention, it is possible to arrange antenna elements at a high density and produce a compact array antenna. Further, since the compactness of the array antenna also makes the system for cooling the conductors comprised of superconductors more compact, the cost of antenna production and the operating cost can be cut. Further, by providing a ¼ wavelength type feeder line as the coupling circuit of the planar antenna element and superconductor circuit, a low loss antenna can be formed.

While the invention has been described with reference to specific embodiments chosen for purpose of illustration, it should be apparent that numerous modifications could be made thereto by those skilled in the art without departing from the basic concept and scope of the invention.

What is claimed is:

1. An antenna coupling module comprising a planar antenna a substrate forming a high frequency circuit and a metal package, the substrate forming the high frequency circuit being arranged in a perpendicular direction with respect to the element surface of said planar antenna and having said planar antenna and said superconductive high frequency circuit electromagnetically coupled via a dielectric body within the metal package, wherein the oxide superconductor for said superconductive high frequency circuit or said planar antenna is at least one type of oxide high-temperature superconductor selected from the group comprised of $Bi_{n1}Sr_{n2}Ca_{n3}Cu_{n4}O_{n5}$ (where, $1.8 \leqq n1 \leqq 2.2$, $1.8 \leqq n2 \leqq 2.2$, $0.9 \leqq n3 \leqq 1.2$, $1.8 \leqq n4 \leqq 2.2$, and $7.8 \leqq n5 \leqq 8.4$), $Pb_{k1}Bi_{k2}Sr_{k3}Ca_{k4}Cu_{k5}O_{k6}$ (where, $1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, and $9.5 \leqq k6 \leqq 10.8$), $Y_{m1}Ba_{m2}Cu_{m3}O_{m4}$ (where, $0.5 \leqq m1 \leqq 1.2$, $1.8 \leqq m \leqq 2.2$, $2.5 \leqq m3 \leqq 3.5$, and $6.6 \leqq m4 \leqq 7.0$), $Nd_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Nd_{q1}Y_{q2}Ba_{q3}Cu_{q4}O_{q5}$ (where, $0 \leqq q1 \leqq 1.2$, $0 \leqq q2 \leqq 1.2$, $0.5 \leqq q1+q2 \leqq 1.2$, $1.8 \leqq q2 \leqq 2.2$, $2.5 \leqq q3 \leqq 3.5$, and $6.6 \leqq q4 \leqq 7.0$), $Sm_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Ho_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$).

2. An antenna coupling module as set forth claim 1, wherein the perpendicular distance of the electromagnetically coupled space has a length of not more than ¼ of the effective wavelength.

3. An antenna coupling module as set forth in claim 2, wherein said effective wavelength includes from a microwave to a milliwave band.

4. An antenna coupling module as set forth in claim 1, wherein said planar antenna and said superconductive high frequency circuit have a ¼ wavelength type feeder line, respectively, as a coupling circuit thereof.

5. An antenna coupling module as set forth in claim 4, wherein a dielectric body is arranged between ¼ feeder lines for coupling circuit of said planar antenna and said superconductive high frequency circuit.

6. An antenna coupling module as set forth in claim 5, wherein at least one type of ingredient selected from the group consisting of magnesium oxide, mullite, forsterite, titanium oxide, lanthanum aluminate, sapphire, alumina, strontium titanate, magnesium titanate, calcium titanate, quartz glass, polytetrafluoro-ethylene, polyethylene, a polyimide, polymethylmethacrylate, a glass-epoxy composite, and a glass-polytetrafluoroethylene composite is used as the ingredient of the dielectric body.

7. An antenna coupling module as set forth in claim 1, wherein an oxide superconductor is used as the conductor of said superconductive high frequency circuit, and said superconductive high frequency circuit has at least one type of circuit selected from the group comprised of a phase circuit, filter circuit, through line, delay circuit, coupler, distribution circuit, and composite circuit.

8. An antenna coupling module as set forth in claim 1, wherein said planar antenna has at least one type of antenna element of the dipole type, patch type, and log-periodic type.

9. An antenna coupling module as set forth in claim 1, wherein an oxide superconductor is used as the conductor for said planar antenna.

10. An antenna coupling module as set forth in claim 1, wherein said planar antenna is a non-superconductive element.

11. An antenna coupling module as set forth in claim 1, wherein said superconductive high frequency circuit or said planar antenna is cooled to not more than 100K.

12. A telecommunications base station mounting an antenna coupling module comprised of a planar antenna and a substrate forming a planar superconductive high frequency circuit arranged in a perpendicular direction with respect to the element surface of said planar antenna and having said planar antenna and said superconductive high frequency circuit electromagnetically coupled via a space, wherein the oxide superconductor for said superconductive high frequency circuit or said planar antenna is at least one type of oxide high-temperature superconductor selected from the group comprised of $Bi_{n1}Sr_{n2}Ca_{n3}Cu_{n4}O_{n5}$ (where, $1.8 \leqq n1 \leqq 2.2$, $1.8 \leqq n2 \leqq 2.2$, $0.9 \leqq n3 \leqq 1.2$, $1.8 \leqq n4 \leqq 2.2$, and $7.8 \leqq n5 \leqq 8.4$), $Pb_{k1}Bi_{k2}Sr_{k3}Ca_{k4}Cu_{k5}O_{k6}$ (where, $1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, and $9.5 \leqq k6 \leqq 10.8$), $Y_{m1}Ba_{m2}Cu_{m3}O_{m4}$ (where, $0.5 \leqq m1 \leqq 1.2$, $1.8 \leqq m \leqq 2.2$, $2.5 \leqq m3 \leqq 3.5$, and $6.6 \leqq m4 \leqq 7.0$), $Nd_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Nd_{q1}Y_{q2}Ba_{q3}Cu_{q4}O_{q5}$ (where, $0 \leqq q1 \leqq 1.2$, $0 \leqq q2 \leqq 1.2$, $0.5 \leqq q1+q2 \leqq 1.2$, $1.8 \leqq q2 \leqq 2.2$, $2.5 \leqq q3 \leqq 3.5$, and $6.6 \leqq q4 \leqq 7.0$), $Sm_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$), $Ho_{p1}Ba_{p2}Cu_{p3}O_{p4}$ (where, $0.5 \leqq p1 \leqq 1.2$, $1.8 \leqq p2 \leqq 2.2$, $2.5 \leqq p3 \leqq 3.5$, and $6.6 \leqq p4 \leqq 7.0$).

* * * * *